US007300027B2

(12) United States Patent
Walker

(10) Patent No.: US 7,300,027 B2
(45) Date of Patent: Nov. 27, 2007

(54) MUSICAL INSTRUMENT HANGER

(76) Inventor: Lawrence Richard Walker, 71 Cox Lake Road, Hammonds Plains (CA) B3Z 1K7

( * ) Notice: Subject to any disclaimer, the term of this patent is extended or adjusted under 35 U.S.C. 154(b) by 0 days.

(21) Appl. No.: 10/887,354

(22) Filed: Jul. 9, 2004

(65) Prior Publication Data

US 2005/0035255 A1 Feb. 17, 2005

Related U.S. Application Data

(60) Provisional application No. 60/485,752, filed on Jul. 10, 2003.

(51) Int. Cl.
*G10D 5/00* (2006.01)

(52) U.S. Cl. ..... 248/121; 248/125.1; 248/312; 84/327

(58) Field of Classification Search ..... 248/312, 248/121, 224.8, 302, 303, 229.26, 229.13, 248/291.1; 211/163, 85.2, 85.6, 39; 84/327; 43/17, 21.2

See application file for complete search history.

(56) References Cited

U.S. PATENT DOCUMENTS

| | | | | | |
|---|---|---|---|---|---|
| 432,305 | A | * | 7/1890 | Foley | 248/229.26 |
| 487,165 | A | * | 11/1892 | Straley | 248/229.13 |
| 615,995 | A | * | 12/1898 | Leonard | 211/22 |
| 1,045,583 | A | * | 11/1912 | Mills | 211/85.6 |
| 1,170,684 | A | * | 2/1916 | Schlieckert | 248/227.3 |
| 1,262,163 | A | * | 4/1918 | Beethoven | 248/230.8 |
| 1,734,577 | A | * | 11/1929 | William | 248/121 |
| 1,890,729 | A | * | 12/1932 | Lewis | 248/167 |
| 1,923,163 | A | * | 8/1933 | Noelting | 248/188.8 |
| 2,153,821 | A | * | 4/1939 | Walberg | 248/121 |
| 2,499,821 | A | * | 3/1950 | Geisheimer | 43/21.2 |
| 2,559,739 | A | * | 7/1951 | Sherman | 211/70 |
| 2,602,618 | A | * | 7/1952 | Cohen | 43/21.2 |
| 3,058,251 | A | * | 10/1962 | Brooks | 43/17 |
| 3,992,798 | A | * | 11/1976 | Schmitt, Sr. | 43/17 |
| 4,366,640 | A | * | 1/1983 | Clapp | 43/21.2 |
| 4,488,469 | A | | 12/1984 | Demello | |
| 4,534,471 | A | * | 8/1985 | Zahn et al. | 211/39 |
| 4,546,688 | A | | 10/1985 | Cuccio | |
| 4,611,722 | A | * | 9/1986 | Teig | 211/107 |
| 5,052,563 | A | * | 10/1991 | Camp | 211/85.2 |
| 5,372,346 | A | * | 12/1994 | Upchurch et al. | 248/304 |
| 5,454,473 | A | * | 10/1995 | Hennessey | 211/85.6 |
| 5,911,396 | A | | 6/1999 | Bireley | |
| 6,036,159 | A | | 3/2000 | Yu | |
| 6,091,008 | A | * | 7/2000 | Yu | 84/327 |
| 6,179,135 | B1 | | 1/2001 | Simpson | |
| 6,209,829 | B1 | | 4/2001 | Yu | |
| 6,231,018 | B1 | * | 5/2001 | Barbieri | 248/302 |
| 6,283,421 | B1 | | 9/2001 | Eason | |

(Continued)

*Primary Examiner*—Anita M. King
(74) *Attorney, Agent, or Firm*—G. Ronald Bell & Associates

(57) ABSTRACT

An instrument hanger attachable to a microphone stand facilitates the supporting or hanging of various musical instruments on the stand. The hanger has an annular loop portion for receiving the top portion of the shaft of the stand, a neck and an instrument holding portion shaped to prevent the instrument to detach from the holder in typically encountered situations. A single hanger may hold several like or different instruments. The hangers taught herein may be more convenient than large conventional musical instrument stands which add to the expense and difficulty of travelling and which may crowd a concert stage.

3 Claims, 9 Drawing Sheets

U.S. PATENT DOCUMENTS 6,316,706 B1 11/2001 Sammons
6,323,405 B1 11/2001 Yu
6,439,532 B1 * 8/2002 Yu ..... 248/443
6,622,981 B1 * 9/2003 Hsieh ..... 248/291.1
6,685,145 B2 * 2/2004 Mackay et al. ..... 248/125.1

* cited by examiner

MUSICAL INSTRUMENT HANGER

This application claims priority from U.S. Provisional Application No. 60/485,752 filed Jul. 10, 2003.

FIELD OF THE INVENTION

The present invention relates generally to the field of hangers and more particularly to hangers for holding musical instruments such as guitars.

BACKGROUND OF THE INVENTION

When not in use, stringed musical instruments may be hung from musical instrument stands. Such stands may be heavy, may have large bases and therefore may add to the expense and difficulty of traveling, especially by plane. On the other hand, a concert stage floor may become crowded by instruments, instrument stands, sheet music stands, microphone stands, as well as other equipment such as cables, speakers and lighting equipment. There is usually a need for space-saving measures in an entertainment stage environment.

The following patents are considered to be of general relevance to the subject matter of the present invention.

U.S. Pat. No. 6,316,706 entitled Multi-Purpose Entertainer Stand issued to Sammons discloses a stand adapted to support one or more microphones, a guitar and a sheet music easel. The base of the guitar is placed on laterally extending feet attached to the base of the stand, and the neck of the guitar is inserted into a c-shaped attachment disposed at an appropriate height above the base.

U.S. Pat. No. 6,323,405 entitled Multifunctional Guitar Stand issued to Yu describes a stand adapted to support a microphone and a guitar. As with the stand of the Sammons patent, the guitar is placed on feet extending laterally from above the base of the stand and the neck of the guitar is inserted into a c-shaped attachment disposed at an appropriate height above the base.

Examples of standard musical instrument stands are taught in U.S. Pat. No. 6,036,159 entitled Musical Instrument Stand issued to Yu; U.S. Pat. No. 6,209,829 entitled Guitar Stand issued to Yu; and U.S. Pat. No. 6,283,421 entitled Instrument Support System issued to Eason et al.

U.S. Pat. No. 4,488,469 entitled Musical Instrument Holder issued to Demello et al. describes a device used for holding sheet music and an instrument. U.S. Pat. No. 4,546,688 entitled Holder for Musical Instruments issued to Cuccio and U.S. Pat. No. 5,313,866 entitled Guitar Stand issued to Smith disclose devices for holding instruments that can be attached to an amplifier. U.S. Pat. No. 5,911,396 entitled Closet Guitar Hanger issued to Bireley describes an apparatus for securement in a closet for hanging a guitar. U.S. Pat. No. 6,179,135 entitled Support Assembly for a Stringed Musical Instrument issued to Yu describes a device that may be attached to a wall or an amplifier for supporting a musical instrument.

It is an object of the present invention to provide a simple and inexpensive instrument hanger for supporting or hanging musical instruments thereon, typically when the instrument is not in use, such hanger suitable for use with an existing or conventional stand or similar equipment.

SUMMARY OF THE INVENTION

In accordance with one aspect the present invention, there is provided an instrument hanger for mounting on a stand having a base and a shaft, the shaft having a free end, the hanger comprising:

a loop portion sized to receive the free end of the shaft therein, and an instrument securement portion connected to the loop portion and shaped to receive a part of an instrument and to prevent the instrument to be detached from said securement portion under a moderate force acting on the instrument in a horizontal or downward direction. In an embodiment of the invention, the hanger may comprise a neck portion interconnecting the loop portion and the securement portion, the neck portion may be dimensioned to provide safety spacing between the instrument and the stand to reduce the possibility of a damaging contact therebetween.

In an embodiment of the invention, the stand is a conventional microphone stand having a shaft with a threaded free end distal from the base of the stand.

The loop portion and the securement portion may be made of a rigid bar having substantially a uniform cross-section throughout the loop portion and the securement portion. In an embodiment where the neck portion is provided, the neck may be made of the same rigid bar. In an embodiment of the invention, the loop portion, the securement portion and optionally the neck portion may comprise a continuous length of the same bar or wire forming at least a part of the loop portion and the securement portion.

In accordance with another aspect of the invention, the above-defined hanger may form part of an instrument hanger kit for hanging an instrument on a stand having a base and a shaft, the shaft having a free end, the kit thus comprising a hanger comprising:

a loop portion sized to receive the free end of the shaft therein, an instrument securement portion connected to the loop portion and shaped to receive a part of an instrument and to prevent the instrument to be detached from said securement portion under a moderate force acting on the instrument in a horizontal or downward direction, and mounting means for releasably immobilizing the hanger on the free end of the shaft.

The free end of the shaft may be threaded, and the mounting means may also be threaded to provide the releasable immobilization.

In an embodiment of the invention, the hanger may comprise a neck portion connecting the loop portion and the securement portion.

The term "moderate force" denotes a reasonable force that may be encountered in a regular use of the instrument hanger, such as an inadvertent push or knock against the stand with the instrument resting on the hanger, a gust of wind, a vibration or a similar occurrence, but not a strenuous force or effort sufficient to distort the hanger.

BRIEF DESCRIPTION OF THE DRAWINGS

Embodiments of the invention will be described below with reference to the accompanying drawings in which like reference numerals correspond to like elements and in which.

DETAILED DESCRIPTION OF EMBODIMENTS OF THE INVENTION

Figure 3:
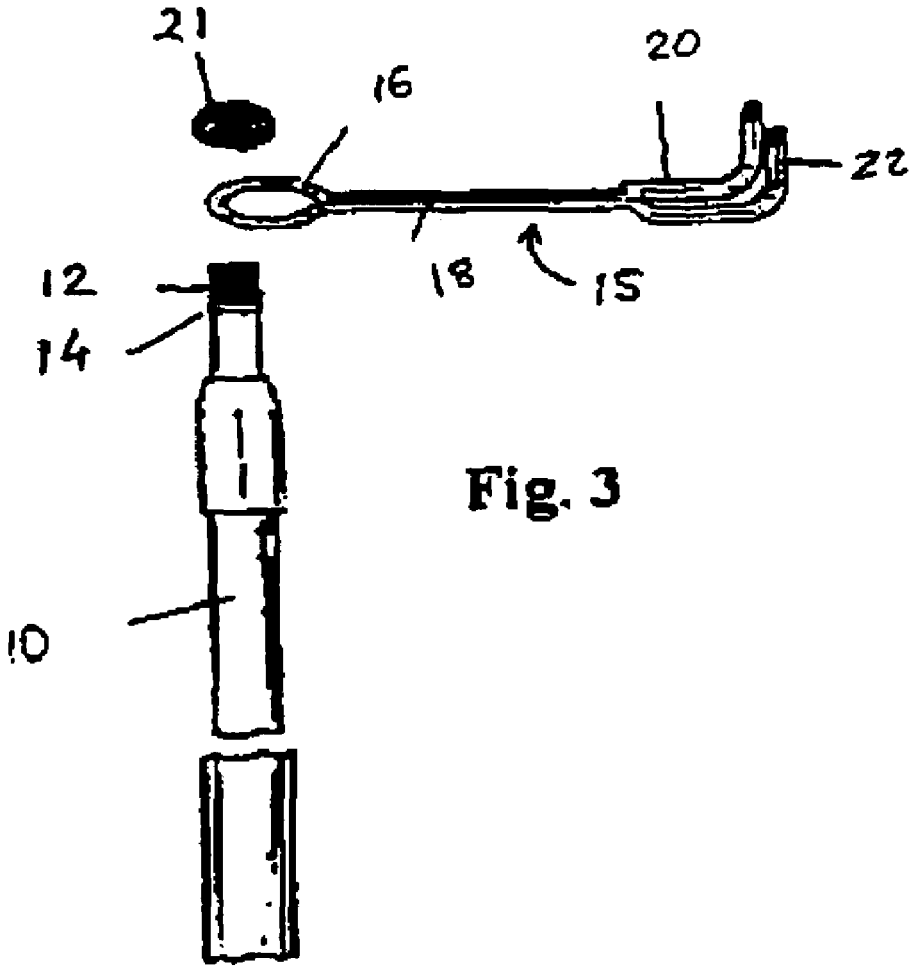
FIG. 3 is a perspective exploded view of a stringed instrument hanger kit of an embodiment of the present invention ready for installation on a stand.

Usually at concert venues, microphone stands are more plentiful than instrument stands. As shown in FIG. 3, a typical microphone stand has a shaft 10, the free end of which is a threaded portion 12.

Figure 5:
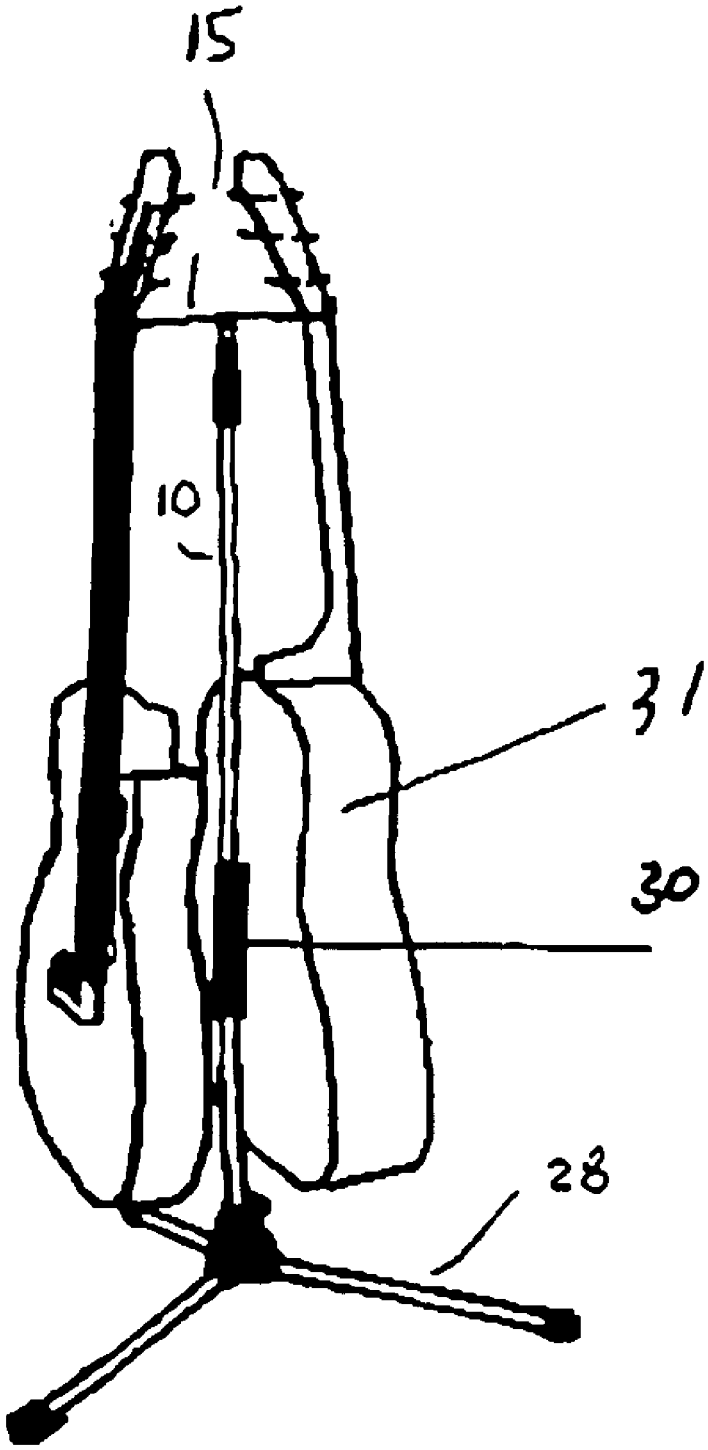
FIG. 5 is a perspective view of a stringed instrument hanger of the present invention with two instruments placed thereon.

The outside diameter of the threaded portion 12 is usually about ⅝", or about 16 mm. The threaded-portion 12 is limited by a collar 14. The full stand is shown in FIG. 5.

Figure 1:
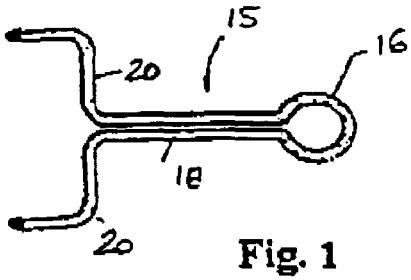
FIG. 1 is a plan view of a stringed instrument hanger of an embodiment of the present invention.

An exemplary musical instrument hanger 15 is shown separately in FIG. 1 and ready for mounting on the stand, in FIG. 3. The hanger is made of a single length of a rigid wire, for example a 2 mm diameter steel wire. The wire should be rigid enough, considering the dimensions of the hanger, to support a specific instrument without significant distortion. Other materials, like a sufficiently rigid polymeric material, e.g. polypropylene, may alternatively be used.

The hanger 15 has a loop portion 16, a neck portion 18 and a fork-shaped instrument securement portion having two prongs 20. The prongs 20 are shown in more detail in FIGS. 2 and 3. In the embodiment illustrated here, the end portions of the prongs have upward bent portions (not necessarily vertically) that are bent to a degree sufficient to prevent the inadvertent displacement of an instrument therefrom as a result, e.g., a vibration, tremor, accidental knock of the stand or the instrument, etc. The prongs or other securement means such as fingers 38 (FIGS. 10 -12) should enable the release of the instrument by an upward force.

The loop portion 16 is sized to fit snugly over the threaded portion 12 of the free end of the shaft 10 and rest against the collar 14. Thus, its diameter should be slightly more than ⅝". The hanger may be made of a round wire as shown herein, or of a bar having a non-circular cross-section which may be the case for an extruded or formed plastic (polymer) bar. In any event, the dimension of the loop portion should preferably be such as to occupy less than the entire length of the threaded portion 12 so that the loop portion can be secured to the shaft 10 with a knurled nut 21 or another equivalent fastening means.

Figure 4:
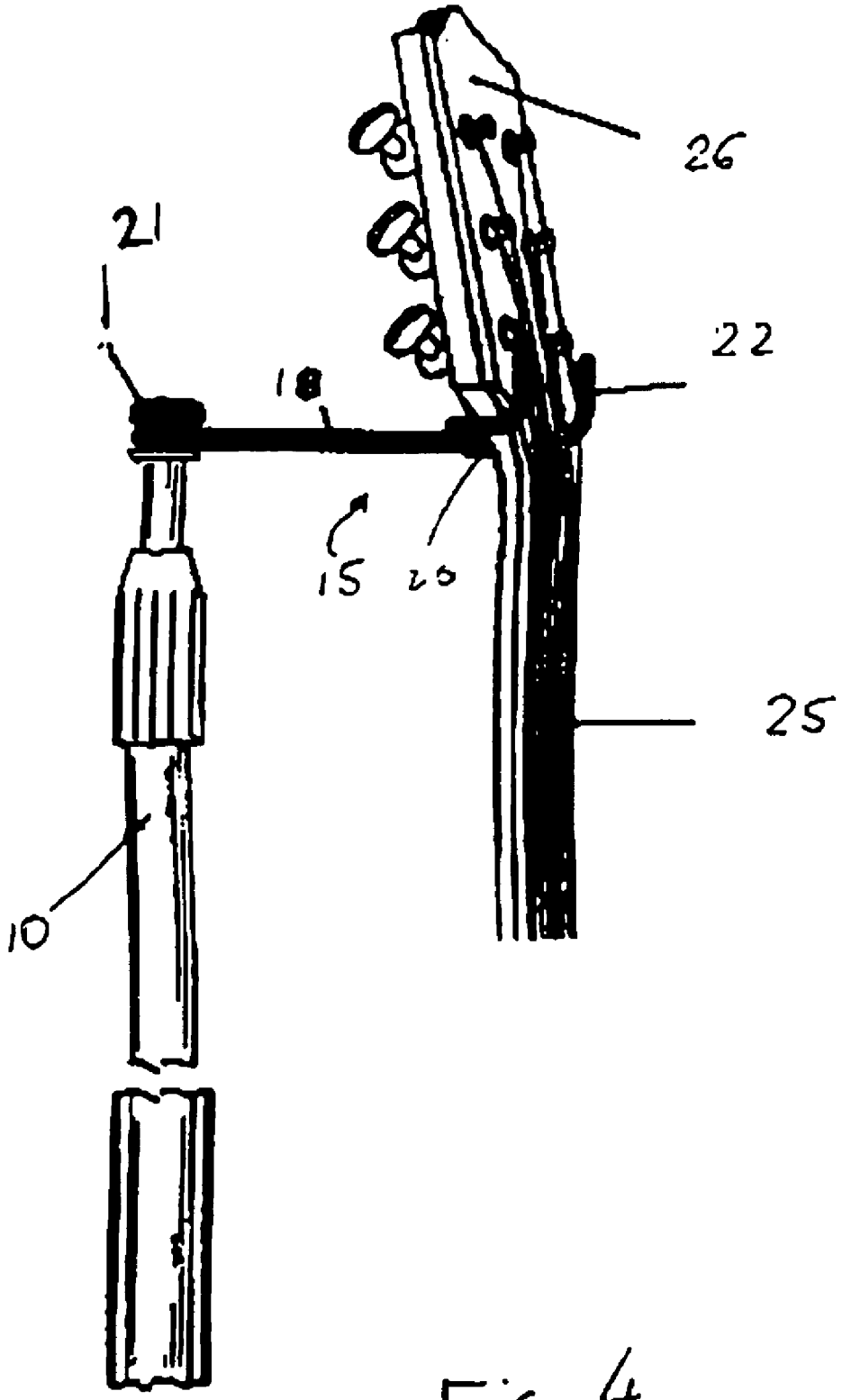
FIG. 4 is a perspective view of a stringed instrument hanger of an embodiment of the present invention with an instrument placed thereon.

When secured with the knurled nut 21 to the shaft 10, as shown in FIG. 4, the hanger 15 extends horizontally with the end portion of the prongs having upward bent end portions 22. The end portions may optionally be covered with a conventional plastic layer to reduce the possibility of damage to the instrument e.g. a guitar 25, when placed on the hanger and to increase the gripping properties. The end portions 22 of the prongs as shown in FIG. 4 are spaced to accommodate the width of the guitar neck and to allow the guitar head 26 to rest against the prongs. It can be seen that this arrangement provides a relatively secure placement for a musical instrument when not in normal use, as the shape, rigidity and dimensions of the prongs can easily be selected for optimum security of the instrument, convenience of use and small size of the hanger. Where the shaft 10 of the microphone stand does not contain a limiting collar 14, an additional knurled nut 21 can be threaded to the bottom of the threaded portion 12 to provide a limiting abutment.

Figure 2:
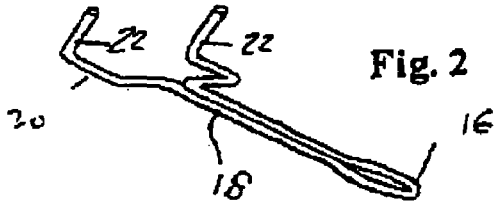
FIG. 2 is a perspective view of the hanger of FIG. 1.

As is clear from FIG. 4, a stringed instrument is placed on the hanger by positioning the instrument's neck between the upward bent end portions 22 of the instrument securement portion and lowering the instrument until the shoulder of the head 26 contacts the horizontal portion of the prongs 20 of the instrument securement portion (FIG. 2). The upward bent end portions 22 of the prongs prevent the instrument from rotating or sliding off the prongs 20.

Turning again to FIGS. 2 and 3, the holder 15 is illustrated as an integral piece made of a single length of a wire or bar having a uniform diameter throughout. This is advantageous as it allows simplicity of manufacturing and material savings.

FIG. 5 shows a two-instrument hanger 15 mounted on a conventional tripod microphone stand 28 with two guitars placed on the hanger. For convenience, a sleeve 30 made of a soft material, e.g., a polyurethane foam, can be placed around the shaft 10 of the stand so that the body of the guitar 31 does not come in direct contact with the stand when the guitar, or the stand, are tipped or pushed towards each other.

Figure 6:
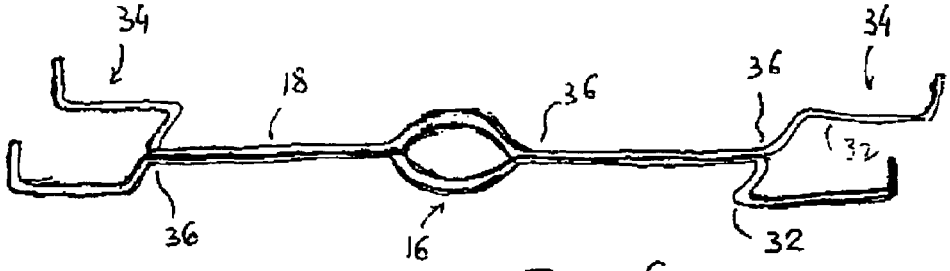
FIG. 6 is a perspective view of a two-instrument hanger of FIG. 5.
Figure 7:
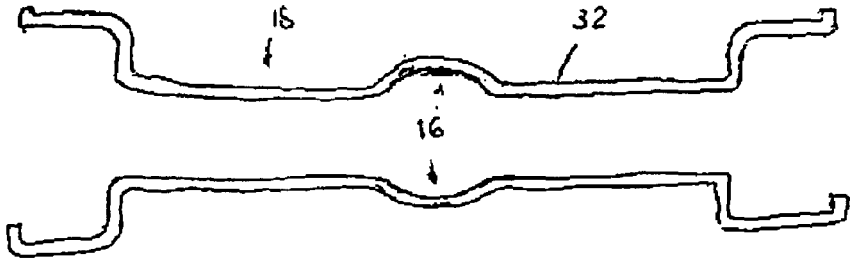
FIG. 7 is a perspective exploded view of the hanger of FIGS. 5 and 6.

FIGS. 6 and 7 show a two-instrument hanger in more detail. The hanger 15 is made of two lengths of wire 32, shaped to form, when assembled, a loop portion 16, a neck portion 18 and two fork-shaped portions 34. The two lengths are joined with spot welds 36 or alternatively with brazing, gluing, etc.

Figure 8:
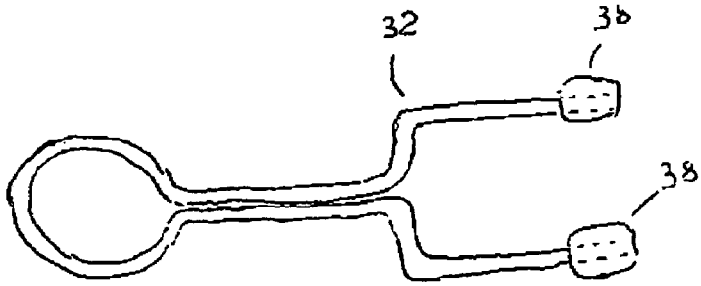
FIG. 8 is a plan view of another embodiment of a one-instrument hanger of the invention.

As shown in FIG. 8 with relation to a single-instrument hanger, the securement portion of the hanger of the invention does not have to be shaped as in FIGS. 1-7. Instead, plastic knobs, or bosses 38, may be secured to the ends of the horizontal portion of the prongs 20 in order to provide a degree of protection against accidental detachment of the instrument from the hanger as discussed above.

Figure 9:
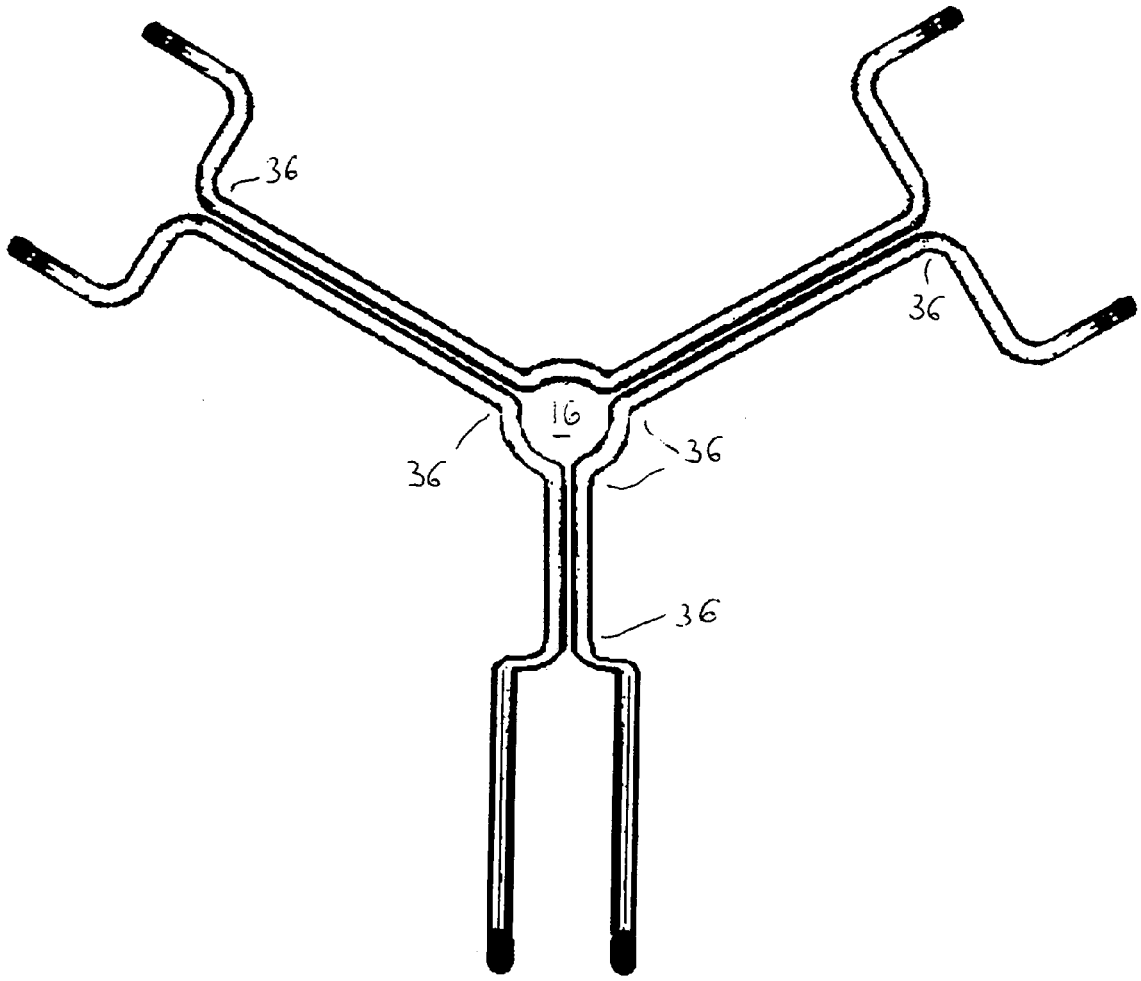
FIG. 9 is a plan view of a three-instrument hanger of the invention.

FIG. 9 shows a three-instrument hanger analogous to that of the embodiment of FIG. 6. Three lengths of a sufficiently rigid wire are shown joined together by spot welds 36 to define a loop portion 16 in the middle, the diameter of the loop portion again chosen to receive a top portion of a stand as shown in FIGS. 3, 4 and 5.

Figure 10:
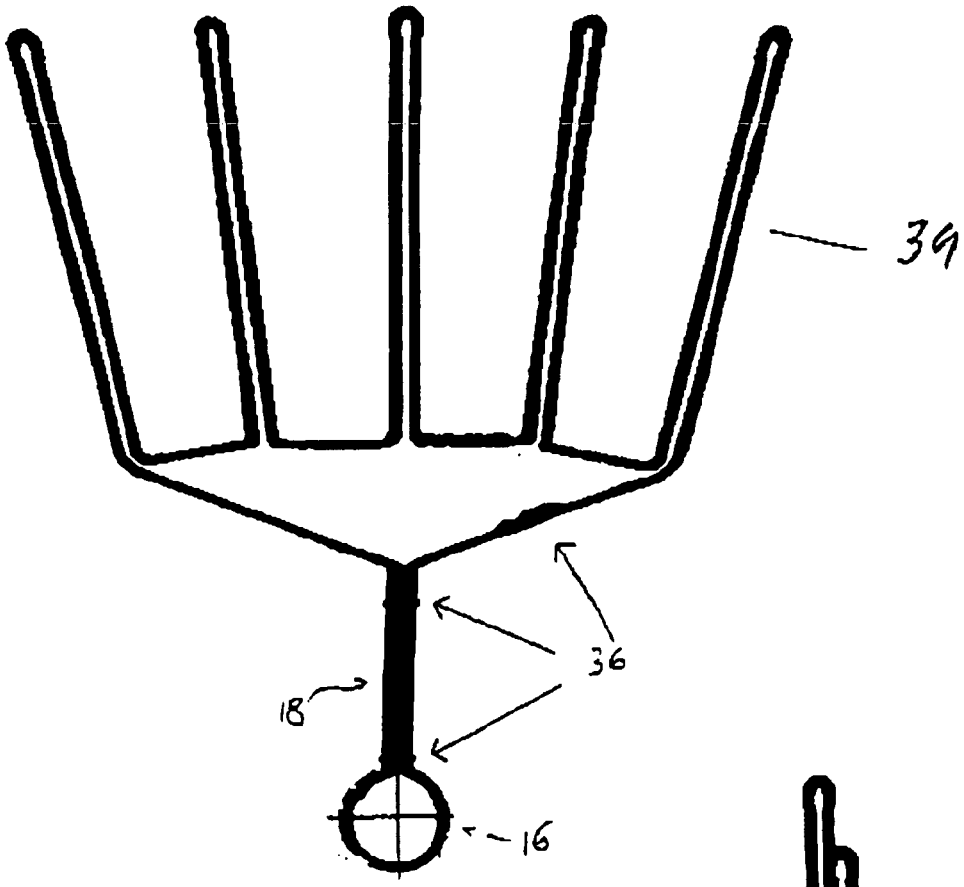
FIG. 10 is a top plan view of a hanger for tubular instruments.
Figure 11:
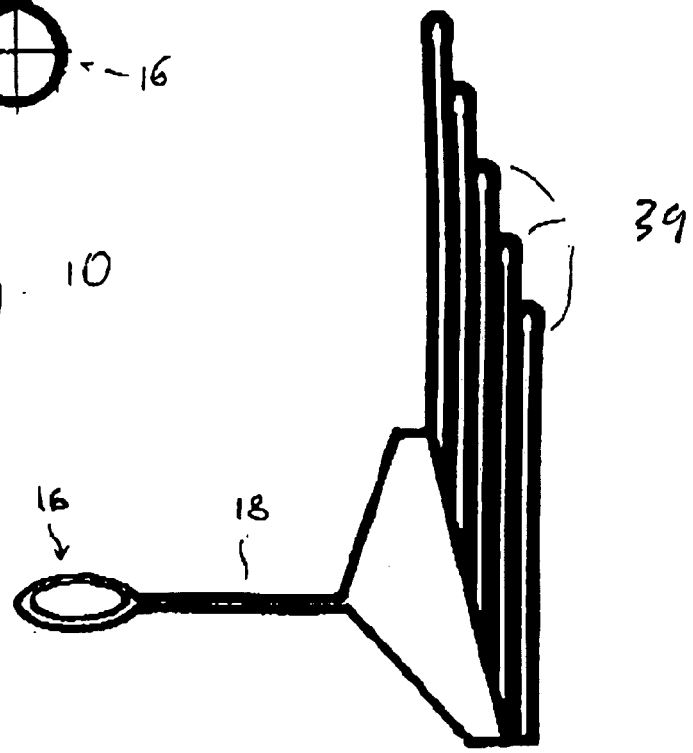
FIG. 11 is a perspective view of the hanger of FIG. 10.

FIGS. 10 and 11 illustrate a multi-instrument hanger for tubular instruments, e.g., whistles or flutes. As shown, the hanger is made of a single length of a rigid wire shaped to define a loop portion 16, a neck portion 18 and a plurality of fingers 39 shaped to fit inside a tubular instrument without damaging the interior structure therein.

Figure 12:
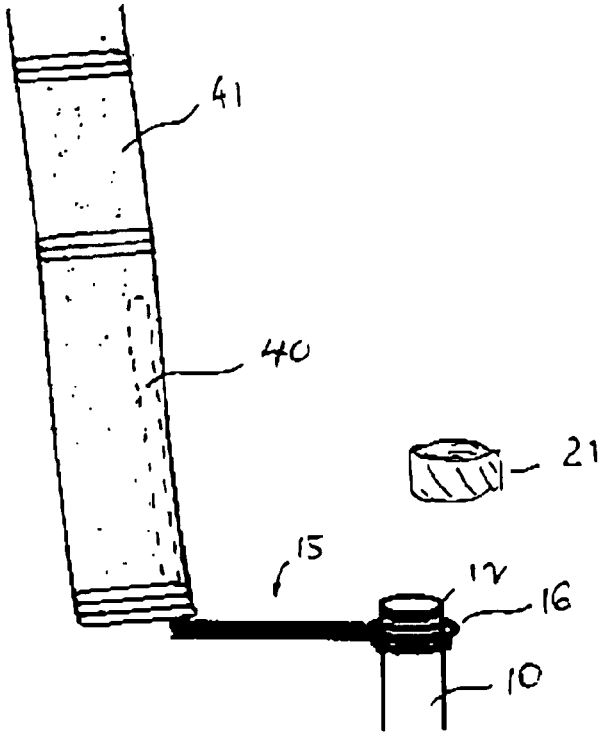
FIG. 12 is a perspective view of a hanger for a single tubular instrument.

A single-flute hanger is illustrated in FIG. 12, where the flute 41 rests on a finger 40 of a hanger 15 that is secured to the threaded portion 12 of the shaft 10 of a microphone stand with a knurled nut 21 or an equivalent means.

Figure 13:
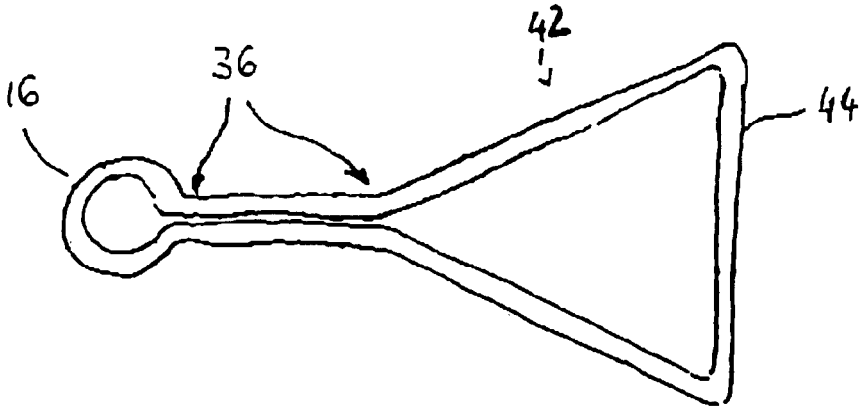
FIG. 13 is a plan view of a violin holder of the present invention.

FIG. 13 illustrates another embodiment of the hanger of the invention where the instrument securement portion is not fork-shaped or finger-shaped, but instead defines a loop-shaped portion 42 which is sized to receive a violin head. The scroll, or "fiddle head", of the violin fits through the triangular loop-shaped portion 42 and comes to rest on the loop, by means of the scroll locking onto a linear side 44 of the triangle.

Figure 14:
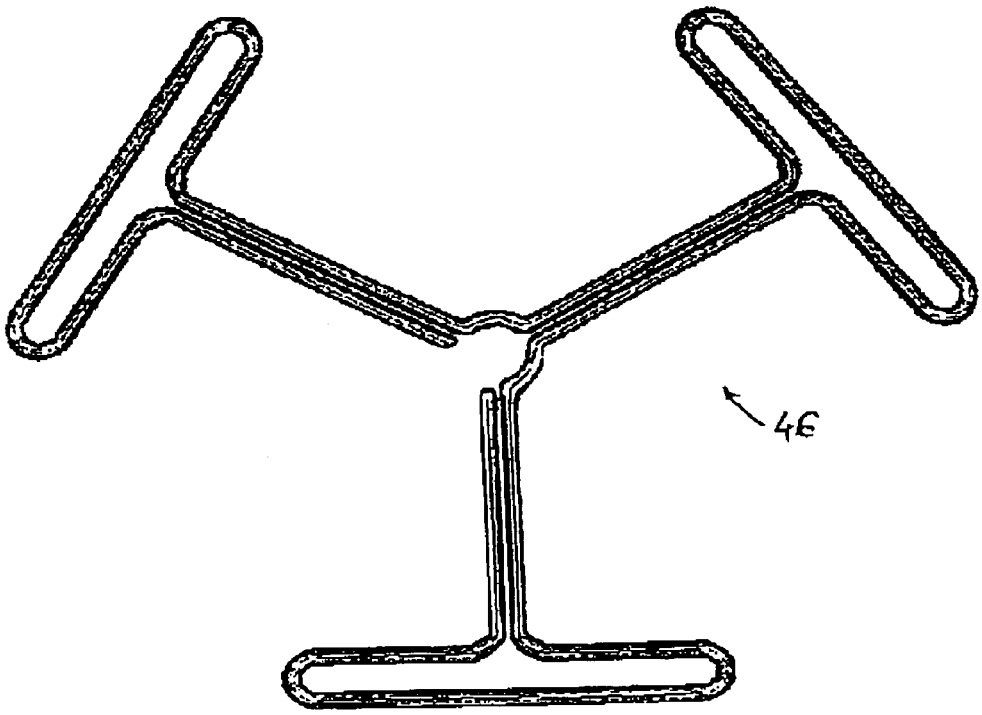
FIG. 14 is a plan view of a stand-off device for securing the body of a musical instrument when placed on a hanger of the invention.

As an alternative to the sleeve 30 shown in FIG. 5, the body 31 of the guitar can be prevented from an undesirable contact with the shaft 10 of the stand by using a stand-off star-shaped element 46 shown in FIG. 14. The element is made of a single length of a steel wire having some resilience enabling a user to bend the legs of the element. Such bending can enable the element to be forced onto the shaft 10 at a position corresponding to the position of the body 31 of the instrument. When in position, the resilience of the material of the element 46 will hold the element on the shaft under friction force. Up to three instruments e.g. guitars may be hanged on a hanger or hangers by their respective necks, wherein the bodies 31 of the instruments will be kept spaced from the shaft by the loop-shaped parts of the element 46.

The hanger 15, the mounting means such as the nut 21, and a stand-off element such as the sleeve 30 or the element 46, may form an instrument hanger kit as defined above.

The present invention, by comparison to certain conventional instrument support devices, has reduced size and weight and improved portability, convenience, durability and may reduce travel expenses.

The foregoing are exemplary embodiments of the present invention and a person skilled in the art would appreciate that modifications to these embodiments may be made without departing from the scope of the invention. For example, the invention may be useful for holding other objects than musical instruments, such objects defined herein as "instruments".

The invention claimed is:

1. An instrument hanger system comprising:

a stand having a base and a shaft, the shaft having a free end and a collar in the proximity of the free end, an instrument hanger having a loop section dimensioned to receive and substantially encircle therein the free end of the shaft; and at least one instrument securement section connected to the loop section, and dimensioned to receive a part of an instrument, wherein the instrument hanger is detachably secured to the shaft by a fastener that engages the shaft in the proximity of the free end, above the instrument hanger and forcibly urges the instrument hanger against the collar and into a plane that is substantially perpendicular to the shaft; and a stand-off element removably attached to said shaft for providing a spacing between said instrument and said shaft.

2. An instrument hanger system according to claim 1, wherein said stand-off element is an elastic sleeve.

3. An instrument hanger system according to claim 1, wherein said stand-off element is a star-shaped element having a shaft engaging section and a plurality of T-shaped sections outwardly projecting from said shaft engaging section.

* * * * *